US007228979B2

(12) United States Patent
Long, Jr.

(10) Patent No.: US 7,228,979 B2
(45) **Date of Patent: *Jun. 12, 2007**

(54) SNAP-ON SCREW-OFF CLOSURE WITH RETAINING MEMBER FOR TAMPER-INDICATING BAND

(75) Inventor: Charles J. Long, Jr., New Castle, PA (US)

(73) Assignee: International Plastics and Equipment Corp., New Castle, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/869,622

(22) Filed: Jun. 16, 2004

(65) Prior Publication Data

US 2004/0251228 A1 Dec. 16, 2004

Related U.S. Application Data

(63) Continuation of application No. 09/145,690, filed on Sep. 2, 1998, now Pat. No. 6,793,082, which is a continuation-in-part of application No. 08/961,440, filed on Oct. 30, 1997, now Pat. No. 6,059,134.

(51) Int. Cl.
*B65D 41/34* (2006.01)
*B65D 41/00* (2006.01)

(52) U.S. Cl. ..... 215/252; 215/253; 215/318; 215/354

(58) Field of Classification Search ..... 215/252, 215/253, 318, 354, 355, 321, 341, 343, 344, 215/45, 44; 220/296, 796, 801, 802
See application file for complete search history.

(56) References Cited

U.S. PATENT DOCUMENTS

| | | | |
|---|---|---|---|
| 1,443,682 | A | 1/1923 | Guerity |
| 1,630,687 | A | 5/1927 | Aulback |
| 1,866,770 | A | 7/1932 | Hilgenberg |
| 2,181,340 | A | 11/1939 | Plumb |
| 2,684,168 | A | 7/1954 | McGinnis |
| 2,789,717 | A | 4/1957 | Demke |
| 2,805,001 | A | 9/1957 | Biederman |
| 2,998,902 | A | 9/1961 | Thomas et al. |
| 3,022,917 | A | 2/1962 | Montgomery |

(Continued)

FOREIGN PATENT DOCUMENTS

| | | |
|---|---|---|
| AT | 245415 | 2/1966 |

(Continued)

OTHER PUBLICATIONS

U.S. Appl. No. 08/633,225 (abandoned), filed Apr. 1996, Long, Jr.

(Continued)

*Primary Examiner*—Robin A. Hylton
(74) *Attorney, Agent, or Firm*—David V. Radack; Robert A. Diaz

(57) ABSTRACT

A closure is provided with a thread configuration adapted for snap-on or screw-on application to a container neck finish. The closure is optionally provided with at least one member attached to the tamper-indicating ring which cooperates with the arcuate projection to assist in breaking said tamper indicating ring during removal of the closure from the container neck.

12 Claims, 4 Drawing Sheets

U.S. PATENT DOCUMENTS

| | | | |
|---|---|---|---|
| 3,073,472 | A | 1/1963 | Williams |
| 3,120,900 | A | 2/1964 | Faulstich |
| 3,123,259 | A | 3/1964 | Musel et al. |
| 3,175,741 | A | 3/1965 | Porter |
| 3,223,269 | A | 12/1965 | Williams |
| 3,372,833 | A | 3/1968 | Baranne |
| 3,392,860 | A | 7/1968 | Faulstich |
| 3,407,957 | A | 10/1968 | Robinson |
| 3,434,613 | A | 3/1969 | Langecker |
| 3,504,818 | A | 4/1970 | Crisci |
| 3,677,430 | A | 7/1972 | Yates, Jr. |
| 3,682,345 | A | 8/1972 | Baugh |
| 3,688,942 | A | 9/1972 | Mitchell |
| 3,695,475 | A | 10/1972 | Ruekberg |
| 3,750,821 | A | 8/1973 | Sourbet et al. |
| 3,792,793 | A | 2/1974 | Rose |
| 3,812,994 | A | 5/1974 | Feldman |
| 3,817,418 | A | 6/1974 | Mastrovito |
| 3,825,144 | A | 7/1974 | Wiedmer |
| 3,837,518 | A | 9/1974 | Gach |
| 3,844,443 | A | 10/1974 | Cudzik |
| 3,865,263 | A | 2/1975 | Birch |
| 3,868,039 | A | 2/1975 | Holbrook |
| 3,874,540 | A | 4/1975 | Hidding |
| 3,893,583 | A | 7/1975 | McLaren |
| 3,901,404 | A | 8/1975 | Feldman |
| 3,902,621 | A | 9/1975 | Hidding |
| 3,913,772 | A | 10/1975 | Ochs |
| 3,928,109 | A | 12/1975 | Pollock et al. |
| 3,940,004 | A | 2/1976 | Faulstich |
| 3,942,679 | A | 3/1976 | Starr |
| 3,963,139 | A | 6/1976 | Gach |
| 3,973,719 | A | 8/1976 | Johnson et al. |
| 3,980,195 | A | 9/1976 | Fillmore |
| 4,034,882 | A | 7/1977 | Wright |
| 4,037,746 | A | 7/1977 | Ver Hage |
| 4,053,077 | A | 10/1977 | DeFelice |
| 4,066,182 | A | 1/1978 | Allen et al. |
| 4,078,700 | A | 3/1978 | Hidding |
| 4,084,716 | A | 4/1978 | Bogert |
| 4,098,419 | A | 7/1978 | Virog, Jr. |
| 4,098,422 | A | 7/1978 | Slomski |
| 4,126,240 | A | 11/1978 | Brach |
| 4,166,552 | A | 9/1979 | Faulstich |
| 4,177,906 | A | 12/1979 | Von Hagel |
| 4,180,175 | A | 12/1979 | Virog et al. |
| 4,196,818 | A | 4/1980 | Brownbill |
| 4,202,455 | A | 5/1980 | Faulstich |
| 4,206,852 | A | 6/1980 | Dunn et al. |
| 4,230,229 | A | 10/1980 | Crisci |
| 4,241,841 | A | 12/1980 | Boller |
| 4,269,320 | A | 5/1981 | Virog, Jr. et al. |
| 4,278,180 | A | 7/1981 | Willis |
| 4,298,129 | A | 11/1981 | Stull |
| 4,301,937 | A | 11/1981 | Von Hagel |
| 4,305,517 | A | 12/1981 | Dennis |
| 4,307,821 | A | 12/1981 | McIntosh |
| 4,330,067 | A | 5/1982 | Deussen |
| 4,343,408 | A | 8/1982 | Csaszar |
| 4,354,609 | A | 10/1982 | Hidding |
| 4,380,303 | A | 4/1983 | Allen et al. |
| 4,385,708 | A | 5/1983 | Curry |
| 4,401,227 | A | 8/1983 | Pehr |
| 4,402,415 | A | 9/1983 | Hopley |
| 4,416,383 | A | 11/1983 | Frahm et al. |
| 4,437,593 | A | 3/1984 | Bullock, III |
| 4,438,857 | A | 3/1984 | Bullock, III |
| 4,448,319 | A | 5/1984 | Kern |
| 4,458,822 | A | 7/1984 | Ostrowsky |
| 4,469,253 | A | 9/1984 | Beard |
| 4,474,314 | A | 10/1984 | Roggenburg, Jr. |
| 4,484,687 | A | 11/1984 | Bullock, III |
| 4,496,066 | A | 1/1985 | Bullock, III |
| 4,497,765 | A | 2/1985 | Wilde |
| 4,498,597 | A | 2/1985 | Bashour |
| 4,500,016 | A | 2/1985 | Funfstuck |
| 4,506,797 | A | 3/1985 | Bullock, III |
| 4,519,569 | A | 5/1985 | Nolan |
| 4,530,437 | A | 7/1985 | Gray |
| 4,534,480 | A | 8/1985 | Santostasi |
| 4,540,098 | A | 9/1985 | Luker |
| 4,540,102 | A | 9/1985 | Wiedmer |
| 4,546,893 | A | 10/1985 | Stull |
| 4,548,329 | A | 10/1985 | Curry |
| 4,550,843 | A | 11/1985 | Nolan |
| 4,561,553 | A | 12/1985 | Crisci |
| 4,567,991 | A | 2/1986 | Anderson |
| 4,572,387 | A | 2/1986 | Luker et al. |
| 4,589,561 | A | 5/1986 | Crisci |
| 4,593,830 | A | 6/1986 | Bullock |
| 4,625,875 | A | 12/1986 | Carr et al. |
| 4,632,265 | A | 12/1986 | Cochrane |
| 4,658,977 | A | 4/1987 | Crisci |
| 4,664,278 | A | 5/1987 | Barriac |
| 4,667,839 | A | 5/1987 | Crisci |
| 4,676,389 | A | 6/1987 | Bullock |
| 4,687,114 | A | 8/1987 | Crisci |
| 4,699,286 | A | 10/1987 | Nolan |
| 4,699,287 | A | 10/1987 | Bullock |
| 4,700,860 | A | 10/1987 | Li |
| 4,709,823 | A | 12/1987 | Beck et al. |
| 4,729,488 | A | 3/1988 | Bullock, III |
| 4,739,891 | A | 4/1988 | Bullock, III |
| 4,744,478 | A | 5/1988 | Hahn |
| 4,746,025 | A | 5/1988 | Krautkramer et al. |
| 4,746,035 | A | 5/1988 | Anderson et al. |
| 4,749,103 | A | 6/1988 | Barriac |
| 4,751,036 | A | 6/1988 | Barriac |
| 4,770,306 | A | 9/1988 | Szczesniak |
| 4,779,764 | A | 10/1988 | Debetencourt |
| 4,785,952 | A | 11/1988 | Obadia |
| 4,796,770 | A | 1/1989 | Begley |
| 4,801,030 | A | 1/1989 | Barriac |
| 4,801,032 | A | 1/1989 | Crisci |
| 4,805,807 | A | 2/1989 | Perne |
| 4,807,770 | A | 2/1989 | Barriac |
| 4,813,577 | A | 3/1989 | Carow |
| 4,815,617 | A | 3/1989 | Cullum |
| 4,815,620 | A | 3/1989 | Bullock, III |
| 4,817,831 | A | 4/1989 | Theisen |
| 4,826,055 | A | 5/1989 | Stull |
| 4,828,127 | A | 5/1989 | Young et al. |
| 4,828,128 | A | 5/1989 | Tackles |
| 4,834,252 | A | 5/1989 | Crisci |
| 4,836,407 | A | 6/1989 | Bruce |
| 4,844,250 | A | 7/1989 | Holoubek et al. |
| 4,844,268 | A | 7/1989 | Bullock, III |
| 4,850,503 | A | 7/1989 | Larsson |
| 4,852,774 | A | 8/1989 | Crawford |
| 4,884,706 | A | 12/1989 | Julian |
| 4,899,898 | A | 2/1990 | Thompson |
| 4,903,849 | A | 2/1990 | Wallman |
| 4,913,300 | A | 4/1990 | Wiedmer et al. |
| 4,919,309 | A | 4/1990 | Arona-Delonghi |
| 4,927,065 | A | 5/1990 | Beck |
| 4,930,647 | A | 6/1990 | Dutt |
| 4,934,546 | A | 6/1990 | Markley |
| 4,938,370 | A | 7/1990 | McBride |
| 4,946,055 | A | 8/1990 | Towns et al. |
| 4,948,001 | A | 8/1990 | Magly |
| 4,948,003 | A | 8/1990 | Munoz |
| 4,971,212 | A | 11/1990 | Kusz |
| 4,981,230 | A | 1/1991 | Marshall et al. |
| 4,989,740 | A | 2/1991 | Vercillo |

5,004,114 A 4/1991 Terbrusch
5,009,323 A 4/1991 Montgomery
5,036,991 A 8/1991 Wallman
5,056,675 A 10/1991 Julian
5,103,991 A 4/1992 Collins
5,104,008 A 4/1992 Crisci
5,105,960 A 4/1992 Crisci et al.
5,129,530 A 7/1992 Fuchs
5,176,300 A 1/1993 Kishikawa et al.
5,186,369 A 2/1993 Aguirrezabal
5,190,178 A 3/1993 Luch
5,199,635 A 4/1993 Abrams et al.
5,213,224 A 5/1993 Luch
5,215,204 A 6/1993 Beck et al.
5,224,616 A 7/1993 Crisci
5,246,125 A 9/1993 Julian
5,267,661 A 12/1993 Luch et al.
5,271,512 A 12/1993 Ekkert
5,285,912 A 2/1994 Molinaro
5,285,933 A 2/1994 Gentes et al.
5,301,849 A 4/1994 Guglielmini et al.
5,303,838 A 4/1994 Luch
5,307,945 A 5/1994 Hidding
5,307,946 A 5/1994 Molinaro
5,328,063 A 7/1994 Beck et al.
5,348,183 A 9/1994 Luch et al.
5,368,178 A 11/1994 Towns
5,379,910 A 1/1995 Montgomery
5,397,009 A 3/1995 Salmon et al.
5,429,282 A 7/1995 Stebick
5,437,140 A 8/1995 Molinaro
5,450,972 A 9/1995 Zemlo
5,456,374 A 10/1995 Beck
5,456,375 A 10/1995 May
5,456,376 A 10/1995 Luch et al.
5,465,876 A 11/1995 Crisci
5,472,120 A 12/1995 Stebick et al.
5,480,045 A 1/1996 Molinaro et al.
5,484,071 A 1/1996 Zumbuhl
5,487,481 A 1/1996 Sander et al.
5,553,727 A 9/1996 Molinaro
5,560,504 A 10/1996 Molinaro
5,588,562 A 12/1996 Sander et al.
5,593,055 A 1/1997 Repp et al.
5,609,263 A 3/1997 Perchepied
5,655,685 A 8/1997 Carr et al.
5,657,906 A 8/1997 Rapchak et al.
5,662,247 A 9/1997 Rapchak et al.
5,676,269 A 10/1997 Blake et al.
5,680,945 A 10/1997 Sander et al.
5,680,965 A 10/1997 Beck
5,685,443 A 11/1997 Taber et al.
5,699,924 A 12/1997 Mascio et al.
5,738,231 A 4/1998 Montgomery
5,779,075 A 7/1998 Salmon et al.
5,810,185 A 9/1998 Groesbeck
5,829,611 A 11/1998 Beck
5,853,095 A 12/1998 Marshall et al.
5,862,953 A 1/1999 Long, Jr.
5,975,369 A 11/1999 Yurkewicz et al.
6,024,255 A 2/2000 Long, Jr.
6,050,452 A 4/2000 Pradinas
6,059,134 A * 5/2000 Long, Jr. ..... 215/252
6,070,766 A 6/2000 Long, Jr.
6,073,809 A 6/2000 Long, Jr.
6,073,810 A 6/2000 Long, Jr.
6,305,579 B1 10/2001 Long, Jr.
6,357,628 B1 3/2002 Long, Jr.
6,431,404 B1 8/2002 Long, Jr.
6,769,575 B1 8/2004 Long, Jr.
6,793,082 B1 * 9/2004 Long, Jr. ..... 215/252

FOREIGN PATENT DOCUMENTS

AU 6658474 9/1975
AU 3337684 3/1986
AU 4739585 3/1986
AU 571893 4/1988
AU 595484 4/1990
AU 2059295 1/1996
AU 3173895 4/1996
AU 39344/95 4/1997
AU 2667797 11/1997
AU 686428 2/1998
BR 9502239 1/1996
BR PI 9509544-6 4/1997
BR PI9710530-9 10/1998
BR PI9712769-8 5/1999
CA 685952 5/1964
CA 812597 5/1969
CA 1260871 9/1989
CA 1286631 7/1991
CA 2151861 12/1995
CA 2271967 5/1999
CA 2303127 3/2000
CA 2307851 4/2000
CH 510563 9/1971
CN 510563 9/1971
CN 1116603 2/1996
CN 1141841 2/1997
CN 95195989.1 3/1998
CN 97195346-5 12/1998
CN 97181203.9 7/1999
CZ 9501629 1/1996
DE 1154369 9/1963
DE 48201 5/1969
DE 2356007 2/1973
DE 2619825 11/1976
DE 2852080 8/1979
DE 3025738 A1 1/1982
DE 41 08 453 10/1991
DE 4321649 1/1995
DK 3723235 A1 1/1989
DK G 9005575.6 7/1990
EP 0009525 4/1980
EP 0009525 A1 4/1980
EP 0080846 A1 6/1983
EP 0103567 3/1984
EP 0118267 9/1984
EP 0176279 A2 4/1986
EP 0298247 5/1988
EP 0337046 10/1989
EP 0 390 412 10/1990
EP 0413466 A1 2/1991
EP 0450959 10/1991
EP 0683106 11/1995
EP 0683106 A1 11/1995
EP 0688724 12/1995
EP 0688724 A1 12/1995
EP 0355949 A1 2/1997
EP 97947524.1 11/1998
EP 1027261 5/2000
FI 952692 12/1995
FR 1536459 7/1967
FR 2421812 12/1979
FR 2538787 7/1984
FR 2659065 9/1991
FR 2682357 4/1993
FR 2692555 A1 12/1993
FR 2721282 12/1995
GB 651018 3/1951
GB 2068912 8/1981
GB 2102774 2/1983

| | | |
|---|---|---|
| GB | 2105693 | 3/1983 |
| GB | 2114553 | 8/1983 |
| GB | 2163413 | 2/1986 |
| GB | 2172273 | 9/1986 |
| GB | 2177384 | 1/1987 |
| GB | 2191178 | 12/1987 |
| GB | 2216505 | 10/1989 |
| GB | 2264110 | 8/1993 |
| GB | 2269163 | 2/1994 |
| HU | 72936 | 6/1996 |
| JP | 8034460 | 2/1996 |
| JP | 8034461 | 2/1996 |
| JP | 3977PC | 4/1997 |
| KR | 97-702817 | 4/1997 |
| MX | 165366 | 11/1992 |
| MX | 99/04463 | 5/1999 |
| MX | 00/04145 | 6/2000 |
| NL | 7312410 | 3/1975 |
| NO | 952384 | 12/1995 |
| PL | 309213 | 12/1995 |
| RU | 2133701 C1 | 5/1997 |
| SK | 81995 | 5/1996 |
| WO | WO 94/14673 | 7/1994 |
| WO | WO94/18084 | 8/1994 |
| WO | WO 96/13442 | 10/1995 |
| WO | WO 96/20872 | 10/1995 |
| WO | WO 96/23699 | 8/1996 |
| WO | WO 97/29969 | 2/1997 |
| WO | WO 97/29969 | 8/1997 |
| WO | WO97/38912 | 10/1997 |
| WO | WO98/21110 | 5/1998 |
| WO | WO 99/12815 | 9/1998 |
| WO | WO 99/12815 | 3/1999 |
| WO | WO 99/23002 | 5/1999 |

OTHER PUBLICATIONS

U.S. Appl. No. 08/603,148 (abandoned), filed Feb. 1996, Long, Jr.

* cited by examiner

SNAP-ON SCREW-OFF CLOSURE WITH RETAINING MEMBER FOR TAMPER-INDICATING BAND

CROSS-REFERENCE

This application is a continuation of U.S. patent application Ser. No. 09/145,690 filed Sep. 2, 1998 (now U.S. Pat. No. 6,793,082), which was a continuation-in-part (CIP) of U.S. patent application Ser. No. 08/961,440 filed Oct. 30, 1997 (now U.S. Pat. No. 6,059,134), the disclosure of which is incorporated herein by reference.

FIELD OF THE INVENTION

The present invention relates to a closure and neck finish for blow-molded containers and in particular to a snap-on closure with a tamper evident locking feature that can be screwed off the container after initial application and then reapplied by screwing the closure onto the container.

RELATED APPLICATIONS

One family of related patent applications assigned to the assignee of the present application include U.S. patent application Ser. No. 09/067,583 filed Apr. 28, 1998, which is a continuation-in-part of U.S. patent application Ser. No. 08/948,342 filed Oct. 8, 1997, which is a continuation-in-part of U.S. patent application Ser. No. 08/927,311 filed Sep. 11, 1997, which is a continuation-in-part of U.S. patent application Ser. No. 08/749,488 filed on Nov. 15, 1996, which is a continuation-in-part of U.S. patent application Ser. No. 08/603,148 filed on Feb. 15, 1996. Another family of related patent applications assigned to the assignee of the present application include U.S. patent application Ser. No. 08/927,743 filed Sep. 11, 1997, which is a continuation-in-part of U.S. patent application Ser. No. 08/838,133 filed on Apr. 15, 1997, which is a continuation-in-part of U.S. patent application Ser. No. 08/687,149 filed on Jul. 24, 1996, which is a continuation-in-part of U.S. patent application Ser. No. 08/633,225 filed on Apr. 16, 1996.

BACKGROUND OF THE INVENTION

Tamper evident caps for containers, such as blow-molded or injection molded containers are well known, see e.g., U.S. Pat. Nos. 4,561,553, 4,625,875, 4,497,765, and 4,534,480. A number of caps are of the snap-on screw-off variety such as U.S. Pat. Nos. 5,553,727, 5,190,178, 5,213,224, 5,267,661, 5,285,912, 5,480,045, 5,456,376, and 5,307,946 and 5,560,504. Generally, the prior art caps include a spiral thread or threads which match a spiral thread on the neck of the bottle. In U.S. Pat. No. 5,307,946 the cap and bottle neck include a seven lead-in end annular spiral thread configuration (or fastening means) and in U.S. Pat. No. 5,553,727 the cap and bottle neck include a ten lead-in end annular spiral thread configuration (or fastening means). The advantage of the multiple lead-in threads is the increased ease of "snap-on" placement of the cap onto the threaded neck using standard bottle capping equipment and without an additional tightening step such as a final twist.

As is apparent from the prior art patents, a great deal of effort has gone into design of cap and bottle neck configurations to provide easy on and off use of the cap by the bottler and ultimately by the end user of the bottled product. However, notwithstanding this effort, the bottling industry continues to search for a cap and neck finish which achieves these objectives but which also provides a secure seal.

The present invention solves this problem by optionally providing at least one annular sealing bead depending from the outer surface of the closure valve which are compressed against the inner surface of the container neck to form a seal as the closure is snapped onto the container neck. Optionally, sealing engagement between the closure and the mating portions of the exterior wall of the container neck may be further improved by including one or more annular sealing beads on the interior surface of the closure depending annular skirt.

The present invention also solves the problem of protecting the integrity of frangible elements during installation of threaded tamper-evident closures. A plurality of elevated areas extend upwardly from the tamper-evident band in spaced relation to the bottom edge of the closure body. The purpose of these elevated areas is to support the tamper evident band in resisting vertical movement imparted by insertion of the closure on the bottle neck, thereby protecting the frangible elements during assembly. The frangible elements connecting the tamper-evident band to the lower edge of the closure body may be configured to extend from these elevated areas as well as the non-elevated areas of the tamper-evident band. The purpose of attaching frangible elements to the elevated areas of the tamper-evident band is to assist in preventing axial misalignment of the tamper-evident band relative to the annular depending skirt portion of the closure upon subjecting the closure to torquing forces during assembly to the container neck.

At least one and preferably a plurality of circumferentially spaced lugs optionally extend from the exterior wall of the container neck. These lugs facilitate breaking the frangible elements on the tamper-evident band of the closure by engaging the frangible elements as the closure is twisted off the container neck following initial snap-on application.

Additionally, the tamper indicating closure may include at least one arcuate projection extending around at least a portion of the tamper indicating ring arranged for registration with an annular locking flange on a container neck portion on which the closure is positioned. The closure is provided with at least one member attached to the tamper-indicating ring which cooperates with the arcuate projection to assist in breaking the tamper indicating ring during removal of the closure from the container neck. The arcuate projection is held in place by the locking flange on the container neck as the member is pulled away from the arcuate projection during twist-off removal of the closure body to cause the tamper indicating ring to break at a weakened area.

Accordingly, it is an object of the present invention to improve sealing engagement between the closure and the mating portions of the interior wall of the container neck by including at least one annular sealing bead depending from the outer surface of the closure valve which are compressed against the inner surface of the container neck to form a seal as the closure is snapped onto the container neck.

It is a further object of the present invention to improve sealing engagement between the closure and the mating portions of the exterior wall of the container neck by including one or more annular sealing beads on the interior surface of the closure depending annular skirt.

It is a further object of the present invention to provide a lug configuration for facilitating the breakage of frangible elements on the tamper evident band of the closure.

It is a further object of the present invention to provide a threaded tamper-evident closure having frangible elements attached from and between a plurality of elevated areas extending upwardly from the tamper-evident band, for protecting the integrity of frangible elements during installation of the closure on a bottle neck.

It is a further object of the present invention to provide a closure with at least one member attached to the tamper-indicating ring which cooperates with the arcuate projection to assist in breaking the tamper indicating ring during removal of the closure from the container neck.

SUMMARY OF THE INVENTION

The present invention provides a closure with a thread configuration adapted for snap-on or screw-on application to a container neck finish. Preferably the closure and neck finish contain eight or nine mating continuous or discontinuous threads for this purpose.

The present invention preferably provides at least one annular sealing bead depending from the outer surface of the closure inner annular sealing flange which are compressed against the inner surface of the container neck to form a seal as the closure is snapped onto the container neck. Optionally, sealing engagement between the closure and the mating portions of the exterior wall of the container neck may be further improved by including one or more annular sealing beads on the interior surface of the closure depending annular skirt.

The present invention also preferably provides plurality of elevated areas extend upwardly from the tamper-evident band in spaced relation to the bottom edge of the closure body to support the tamper evident band in resisting vertical movement imparted by insertion of the closure on the bottle neck, thereby protecting the frangible elements during assembly. The frangible elements connecting the tamper-evident band to the lower edge of the closure body may be configured to extend from these elevated areas as well as the non-elevated areas of the tamper-evident band to assist in preventing axial misalignment of the tamper-evident band relative to the annular depending skirt portion of the closure upon subjecting the closure to torquing forces during assembly to the container neck.

Additionally, the tamper indicating closure may include at least one arcuate projection extending around at least a portion of the tamper indicating ring arranged for registration with an annular locking flange on a container neck portion on which the closure is positioned. The closure is optionally provided with at least one member attached to the tamper-indicating ring which cooperates with the arcuate projection to assist in breaking the tamper indicating ring during removal of the closure from the container neck. The arcuate projection is held in place by the container neck as the member is pulled away from the arcuate projection during twist-off removal of the closure body to cause the tamper indicating ring to break at a weakened area.

At least one and preferably a plurality of circumferentially spaced lugs optionally extend from the exterior wall of the container neck to facilitate breaking the frangible elements on the tamper-evident band of the closure by engaging the frangible elements as the closure is twisted off the container neck following initial snap-on application.

Other advantages of the present invention will become apparent by a perusal of the following detailed description of a presently preferred embodiment of the invention taken in connection with the drawings.

DETAILED DESCRIPTION OF THE PRESENTLY PREFERRED EMBODIMENT

Figure 1:
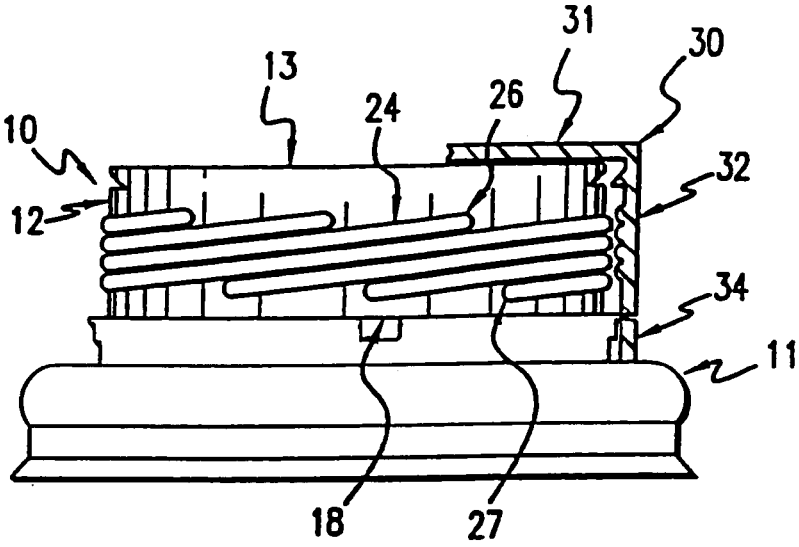
FIG. 1 is an elevation in partial section of a bottle neck finish and closure according to the present invention.
Figure 1A:
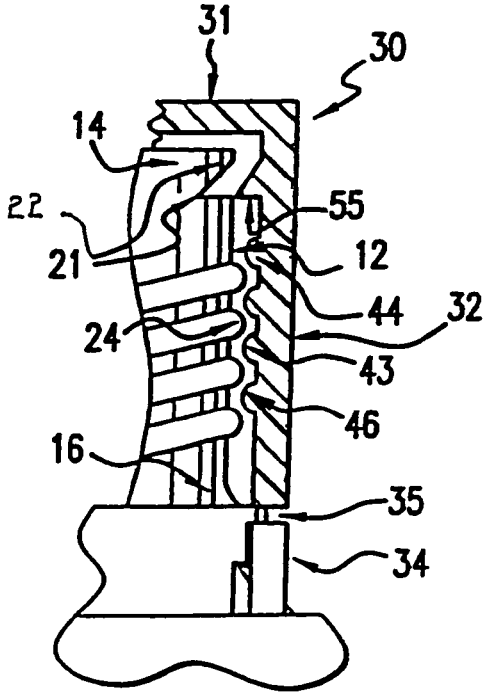
FIG. 1A is an enlarged view of the circumferential mating engagement of the closure and container neck shown in FIG. 1.

Referring to FIGS. 1 and 1A, the neck finish 10 of a container 11 is partially shown. Neck finish 10 is preferably made of plastic and more preferably a high density plastic suitable for blow molding manufacture of the neck finish 10. Neck finish 10 includes an annular wall 12 having a first end 14 and a second end 16 and defining a cylindrical opening 13 within the neck finish 10, with first end 14 providing access to opening 13.

Positioned adjacent to second end 16 is at least one and preferably a plurality of circumferentially spaced lugs 18 projecting from the exterior wall of the container neck. Lugs 18 may be preferably positioned around the entire circumference of the annular wall 12 or alternately only a portion thereof. Lugs 18 facilitate breaking the frangible elements on the tamper-evident band 34 of the closure 30 by engaging frangible elements 35 connecting the tamper-evident band 34 to the closure 30 as the closure 30 is twisted off the container neck 10 following initial snap-on application of the closure 30.

Helically extending between first end 14 and the second end 16 of the annular wall 12 are an appropriate number of threads to permit snap-on or screw-on application, preferably eight or nine threads 24 terminating at points 26 and 27 proximate to the first end 14 and second end 16 of annular wall 12, respectively. Preferably, threads 24 are helically spaced in a continuous relationship as shown in FIG. 1 but threads 24 can alternately be discontinuous and can take on any cross-sectional profile suitable for mating with threads 43 on the closure 30 during snap and screw-on application of the closure 30 to the neck finish 10.

Closure 30 is preferably made from a low or high density polypropylene suitable for blow molding manufacturing. Cap 30 comprises a closure member 31 designed to cover the cylindrical opening 13 of the container neck finish 10. In a preferred embodiment of the invention, closure member 31 is substantially circular and an annular wall 32 circumferentially surrounding at least a portion of neck finish 10 depends from closure member 31.

Figure 2:
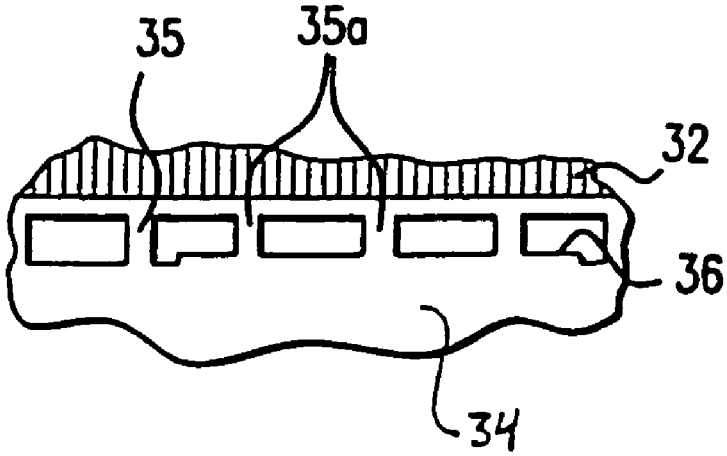
FIGS. 2 and 2A are enlarged sectional views of the tamper-evident band of the closure of the present invention.
Figure 2A:
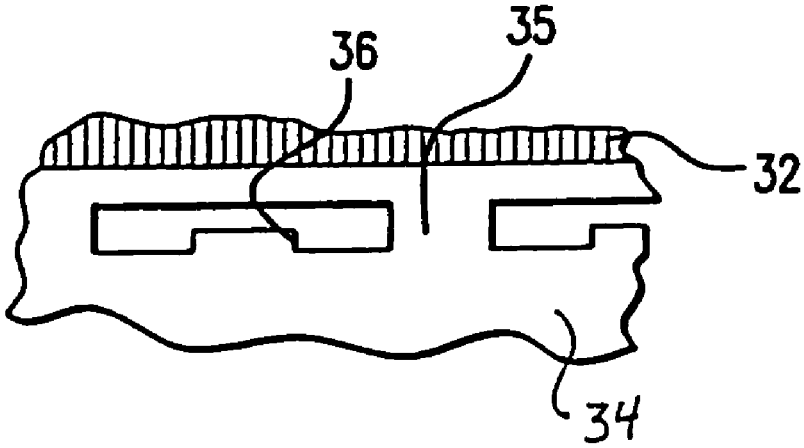

Annular wall 32 includes a tamper-evident band 34 around the end opposite the closure member 31. Tamper-evident band 34 includes at least one and preferably a plurality of frangible elements 35 extending around at least a portion of the circumference of the tamper-evident band 34. As shown in FIGS. 2 and 2A, at least one and preferably a plurality of elevated areas 36 extend upwardly from the tamper-evident band 34 in spaced relation to the bottom edge of annular wall 32. The purpose of these elevated areas is to support the tamper evident band 34 in resisting vertical movement imparted by insertion of the closure on the bottle neck, thereby protecting the frangible elements 35 during assembly. As shown in FIG. 2, the frangible elements 35*a* connecting the tamper-evident band 34 to the lower edge of annular wall 32 may be configured to extend from these elevated areas 36 as well as from the non-elevated areas of the tamper-evident band 34. The purpose of attaching frangible elements to the elevated areas 36 of the tamper-evident band 34 is to assist in preventing axial misalignment of the tamper-evident band 34 relative to the annular wall portion 32 of the closure 30 upon subjecting the closure 30 to torquing forces during snap-on assembly to the container neck finish 10.

Figure 4:
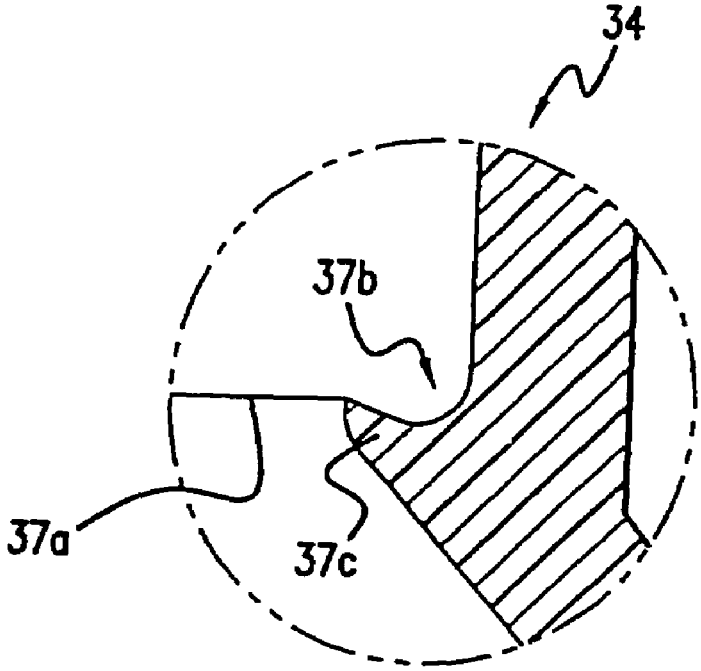
FIG. 4 is an exploded view of the arcuate locking projection of the present invention.

Optionally, tamper-evident band 34 may be configured with at least one or more arcuate flanged locking projections 37 circumferentially spaced about the inner surface of the tamper evident ring 34 and positioned so that they are engageable under an annular locking flange on a bottle neck (not shown) to lock the closure 30 on the bottle neck. As can be seen in FIG. 4, arcuate projections 37 can comprise edges 37*a* defining grooves 37*b* formed on radially upwardly extending annular flanges 37*c*. Flanges 37*c* can be discontinuous or continuous. Edge 37*a* and groove 37*b* provide a "hook" shape for engaging the annular locking flange on the container neck (not shown) which has a radius substantially the same as groove 37*b*. The surface of flange 37*c* may lie at an angle with a plane normal to the inner surface of the tamper-evident band 34, thereby defining a grooved "hook" with a reverse basis allowing flange 37*c* to slide over the locking flange on the bottle neck when the closure is placed on the container but which engages and locks the closure to the container when removal of the closure is attempted with the tamper-evident band 34 intact. The aforementioned angle may vary over the surface of flange 37*c* such that at least a portion of the flange surface lies substantially parallel to the interior surface of the tamper indicating band 34. This flanged edge and groove configuration 37*a*-37*c* may be positioned at any elevation on the surface of tamper-evident band 34, including a position adjacent to the bottom edge of tamper-evident band 34 as shown in FIG. 4. Because groove 37*b* is undercut, a mold core must be used that frees or permits removal of undercut prior to stripping the closures from the mold. Various techniques are known to those skilled in the art including the use of movable core sleeves which free the undercut section of the mold.

Figure 5:
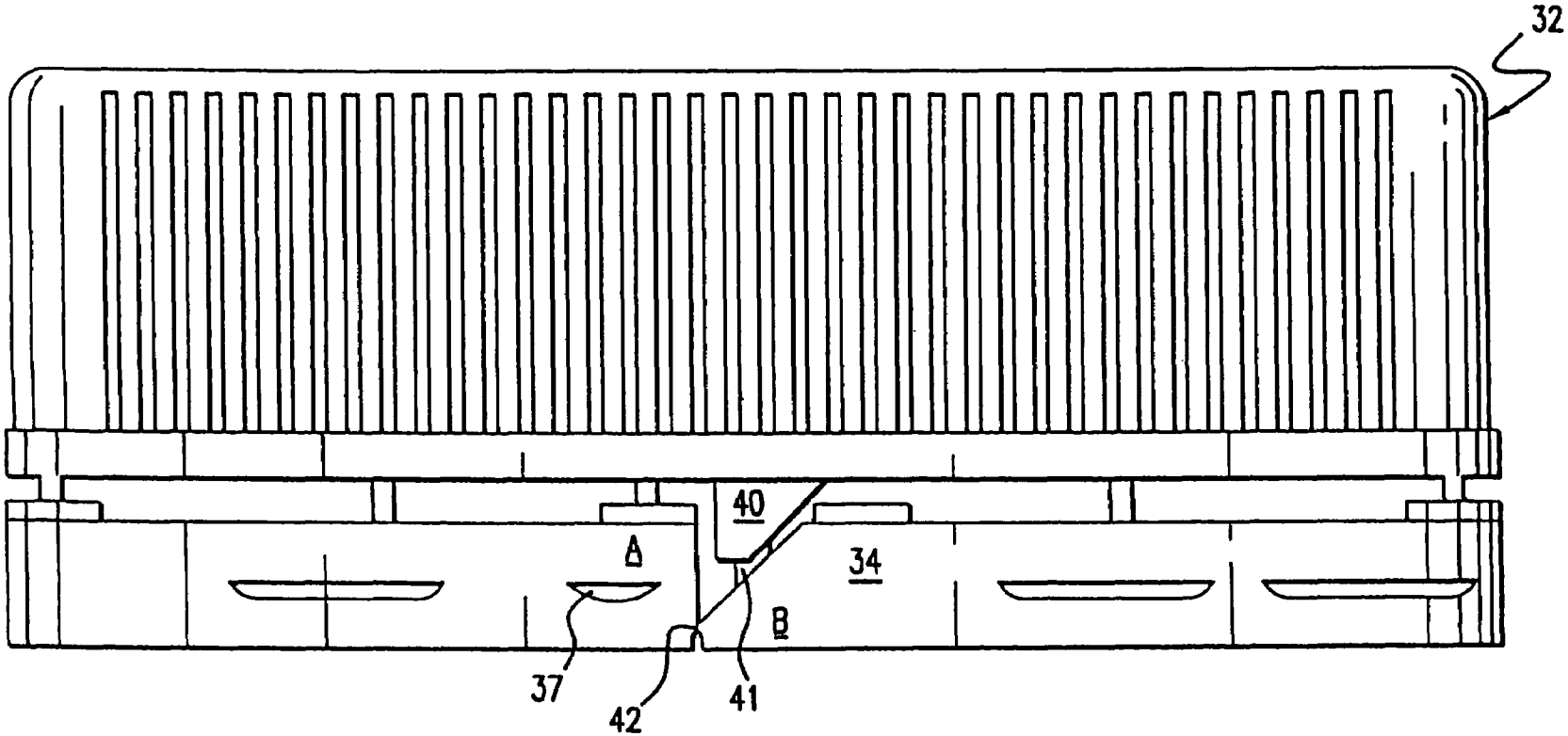
FIG. 5 is a plan view of the closure showing the cooperation of the arcuate locking projection with a member extending from the closure body to facilitate breaking the tamper-evident band.

As shown in FIG. 5, tamper-evident band 34 is also attached to a member 40 extending from annular wall 32 to facilitate breaking the tamper-evident band 34 when unscrewing the closure 30 to remove it from the neck finish 10 of the container 11. Preferably member 40 is also attached to the tamper-evident band 34 by a strip 41 of material extending between member 40 and tamper-evident band 34 and located proximate to a weakened area 42 formed in the tamper evident band 34. The unscrewing of the closure 30 from the container neck finish 10 produces an upward force on the member 40 which is translated through strip 41 to the attached portion B of the tamper-evident band 34. This upward force acts in concert with a downward force exerted by interference between the container neck finish 10 and the portion A of the tamper-evident band 34 containing arcuate flange 37 to cause the weakened area 42 to rupture, thereby breaking the tamper-evident band 34 to allow the closure 30 to be removed from the container 11. The tamper-evident band 34 will remain with the closure 30 due to the strip 41 attaching the member 40 to the tamper-evident band 34. Strip 41 can subsequently be completely broken away to allow removal of the tamper-evident band 34 from the closure 30.

Extending from a location proximate to closure member 31 to a location proximate to tamper-evident band 35 are an appropriate number of threads to permit snap-on or screw-on application, preferably eight or nine helically spaced threads 43 on the inner surface of annular depending wall 32 each having respective lead openings 44 and 46. Preferably, closure threads 43 are helically spaced in a continuous relationship as shown in FIG. 1A but threads 43 can alternately be discontinuous and can take on any cross-sectional profile suitable for mating with threads 24 on the container neck finish 10 during snap and screw-on application of the closure 30 to the neck finish 10.

Figure 3:
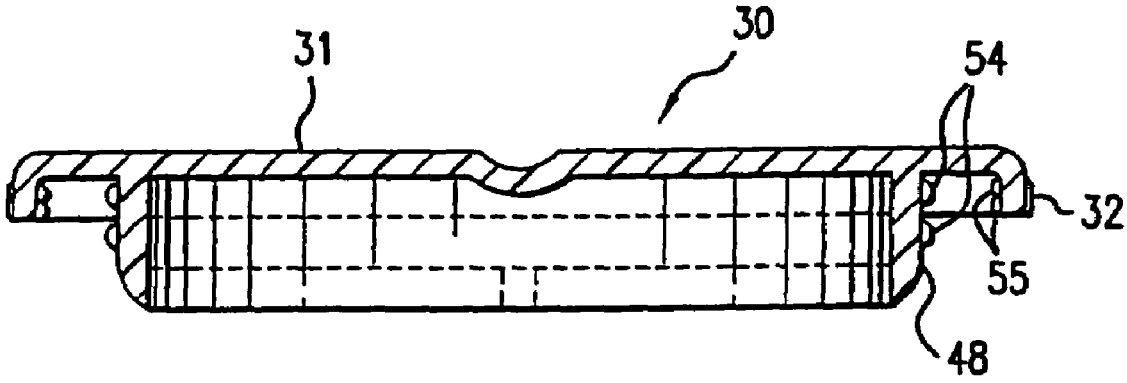
FIG. 3 is a sectional view of the closure sealing valve as it is attached to the closure of the present invention.

As shown in FIG. 3, depending from closure member 31 is depending annular inner annular sealing flange 48. Annular inner annular sealing flange 48 is spaced apart from annular depending closure wall 32 a distance which is represented by the difference in the radial distance between the outer surface of the annular neck finish wall 12 and the center of the circumferential opening 13 on the one hand and the radial distance between the inner surface of annular wall 12 and the center of the circumferential opening 13 on the other hand. Preferably inner annular sealing flange 48 includes a taper proximate to its lower edge which permits initial engagement of the inner annular sealing flange 48 to the inner periphery of the neck finish 10 opening upon application of the closure 30 to the neck finish 10. Optionally, inner annular sealing flange 48 contains at least one and preferably a plurality of annular sealing beads 54 depending from the outer surface of the closure inner annular sealing flange which are compressed against the inner surface of the container neck annular wall 12 to form a seal as the closure 30 is snapped onto the container neck 10. Annular sealing beads 54 also contribute to the sealing force of the closure disk 31 against the container neck finish 10 as beads 54 lock beneath corresponding flanges on the inner surface of the container neck 10 (not shown).

Optionally, sealing engagement between the closure 30 and the mating portions of the exterior of the container neck annular wall 12 may be further improved by including one or more annular sealing beads 55 extending around at least a portion of the interior surface of the closure depending annular skirt 32. In the preferred embodiment an annular sealing bead 55 is positioned on annular wall 32 proximate of closure element 31 and is located and dimensioned to engage and cooperatively secure closure 30 to an annular ring flange 22 or groove 21 on neck finish 10 when the cap is snapped onto the neck finish 10.

Cap 30 when used in combination with neck finish 10 of the present invention permits the placement of the cap on the neck finish by snap-on or twist-on application. By preferably utilizing eight or nine threads 24 and 43, it is not necessary to screw the cap on or off the neck. However, by twisting the cap it is possible to obtain an even more secure closure when used by the ultimate consumer, while at the same time providing a leak proof container at the capping station without the necessity of so twisting.

While presently preferred embodiments of the invention have been shown and described in particularity, the invention may be otherwise embodied within the scope of the appended claims.

What is claimed is:

1. A tamper indicating closure configured for snap-on or screw-on application to a container, said closure comprising:

a. a closure top portion;

b. an annular depending skirt extending from said top portion, said depending skirt having an internal thread configuration adapted for engaging an external thread configuration on the neck portion of said container by snap-on application during initial installation of said closure to the container neck;

c. an inner annular sealing flange depending from said closure top portion in spaced relation to said depending skirt; and d. a tamper indicating ring connected to said depending skirt by a plurality of frangible elements;

wherein said tamper indicating ring includes at least one arcuate projection extending around at least a portion of said tamper indicting ring arranged for registration with a container neck portion on which said closure is positioned and said closure includes at least one non-removable member breakably attached to said tamper-indicating ring which cooperates with at least one said arcuate projection to assist in breaking said tamper indicating ring during removal of said closure from said container neck;

wherein at least one said arcuate projection is held in place by an annular locking flange on the container neck as said member is pulled away from said arcuate projection by twist-off removal of said annular depending skirt to cause said tamper indicating ring to break at a weakened area as said member pulls said tamper indicating ring upward to cause breakage of said frangible elements connecting said skirt to said tamper indicating ring and fracture of said weakened area by separation of said portion of said tamper indicating ring attached to said member from said portion of said tamper indicating ring attached to said arcuate projection;

wherein said tamper indicating ring includes an elevated area extending axially towards said depending skirt, wherein said elevated area defines a region of decreased ring spacing from said depending skirt and further comprising a plurality of said frangible elements and said elevated areas, wherein at least one of said frangible elements is connected to said depending skirt between two said elevated areas and wherein at least one other said frangible element is connected to said depending skirt from an elevated area; and wherein said elevated areas extending from said tamper indicating ring are of a known vertical height, and said frangible elements are of a height greater than that of said known height of said elevated areas.

2. A tamper indicating closure configured for snap-on or screw-on application to a container, said closure and container comprising in combination:

a. a closure top portion;

b. an annular depending skirt extending from said top portion, said depending skirt having an internal thread configuration adapted for engaging an external thread configuration on the neck portion of said container by snap-on application during initial installation of said closure to said container neck;

c. an inner annular sealing flange depending from said closure top portion in spaced relation to said depending skirt; and d. a tamper indicating ring connected to said depending skirt by a plurality of frangible elements;

wherein said tamper indicating ring includes at least one arcuate projection extending around at least a portion of said tamper indicating ring arranged for registration with a container neck portion on which said closure is positioned and said closure includes at least one non-removable member breakably attached to said tamper-indicating ring which cooperate with at least one said arcuate projection to assist in breaking said tamper indicating ring during removal of said closure from said container neck;

wherein at least one said arcuate projection is held in place by an annular locking flange on said container neck as said member is pulled away from said arcuate projection by twist-off removal of said annular depending skirt to cause said tamper indicating ring to break at a weakened area as said member pulls said tamper indicating ring upward to cause breakage of said frangible elements connecting said skirt to said tamper indicating ring and fracture of said weakened area by separation of said portion of said tamper indicating ring attached to said member from said portion of said tamper indicating ring attached to said arcuate projection;

wherein said tamper indicating ring includes an elevated area extending axially towards said depending skirt, wherein said elevated area defines a region of decreased ring spacing from said depending skirt and further comprising a plurality of said frangible elements and said elevated areas, wherein at least one of said frangible elements is connected to said depending skirt between two said elevated areas and wherein at least one other said frangible element is connected to said depending skirt from an elevated area; and wherein said elevated areas extending from said tamper indicating ring are of a known vertical height, and said frangible elements are of a height greater than that of said known height of said elevated areas.

3. The tamper indicating closure of claim 1 or 2, wherein said inner annular sealing flange includes at least one annular sealing bead extending around said inner annular sealing flange and being configured for engagement with the interior surface of said container neck finish.

4. The tamper indicating closure of claim 1 or 2, wherein said inner annular sealing flange includes at least one annular sealing bead extending around said inner annular sealing flange and being configured for engagement with the interior surface of said container neck finish.

5. The tamper indicating closure of claim 1 or 2, wherein said annular depending skirt includes at least one annular sealing bead extending around said skirt and being configured for engagement with the exterior surface of said container neck finish.

6. The tamper indicating closure of claim 4, wherein said annular depending skirt includes at least one annular sealing bead extending around said skirt and being configured for engagement with the exterior surface of said container neck finish.

7. The tamper indicating closure of claim 5, wherein at least one said annular sealing bead engages a sealing groove on the exterior of said container neck finish.

8. The tamper indicating closure of claim 6, wherein at least one said annular sealing bead engages a sealing groove on the exterior of said container neck finish.

9. The tamper indicating closure of claim 1 or 2, wherein said thread configurations contain eight or nine circumferentially spaced individual thread leads.

10. The tamper indicating closure of claim 9, wherein said thread leads are segmented.

11. The tamper indicating closure of claim 1 or 2, wherein at least one said arcuate projection comprises a grooved locking member.

12. A tamper indicating closure configured for snap-on or screw-on application to a container, said closure and container comprising in combination:

a. a closure top portion;

b. an annular depending skirt extending from said top portion, said depending skirt having an internal thread configuration adapted for engaging an external thread configuration on the neck portion of said container by snap-on application during initial installation of said closure to said container neck;

c. an inner annular sealing flange depending from said closure top portion in spaced relation to said depending skirt; and d. a tamper indicating ring connected to said depending skirt by a plurality of frangible elements;

wherein said tamper indicating ring includes at least one arcuate projection extending around at least a portion of said tamper indicating ring arranged for registration with a container neck portion on which said closure is positioned and said closure includes t lest one nonremovable member breakably attached to said tamper-indicating ring which cooperates with at least one said arcuate projection to assist in breaking said tamper indicating ring during removal of said closure from said container neck;

wherein at least one said arcuate projection is held in place by an annular locking flange on said container neck as said member is pulled away from said arcuate projection by twist-off removal of said annular depending skirt to cause said tamper indicating ring to break at a weakened area as said member pulls said tamper indicating ring upward to cause breakage of said frangible elements connecting said skirt to said tamper indicating ring and fracture of said weakened area by separation of said portion of said tamper indicating ring attached to said member from said portion of said tamper indicating ring attached to said arcuate projection; and wherein said tamper indicating ring includes an elevated area extending axially towards said depending skirt, wherein said elevated area defines a region of decreased ring spacing from said depending skirt and further comprising a plurality of said frangible elements and said elevated areas, wherein at least one of said frangible elements is connected to said depending skirt between two said elevated areas and wherein at least one other said frangible element is connected to said depending skirt from an elevated area.

* * * * *